United States Patent [19]

Shepherd

[11] Patent Number: 4,707,957

[45] Date of Patent: Nov. 24, 1987

[54] PREASSEMBLED PLATFORM STAIRWAY

[76] Inventor: John D. Shepherd, 13301 Cedar Creek Ct., Lockport, Ill. 60441

[21] Appl. No.: 900,549

[22] Filed: Aug. 20, 1986

[51] Int. Cl.[4] ..... E04F 11/06

[52] U.S. Cl. ..... 52/183; 182/115

[58] Field of Search ..... 52/182–185; 182/115, 116, 152

[56] References Cited

U.S. PATENT DOCUMENTS

| | | | |
|---|---|---|---|
| 3,670,848 | 6/1972 | Raiguel | 52/185 |
| 3,707,814 | 1/1973 | Seegers | 52/185 |
| 4,157,742 | 6/1979 | Asnensen | 182/116 |

FOREIGN PATENT DOCUMENTS

| | | | |
|---|---|---|---|
| 1064149 | 12/1953 | France | 182/115 |
| 160823 | 11/1964 | U.S.S.R. | 52/185 |

*Primary Examiner*—James L. Ridgill, Jr.

*Attorney, Agent, or Firm*—Mason, Kolehmainen, Rathburn & Wyss

[57] ABSTRACT

A preassembled platform stairway for installation between an upper floor and an adjacent lower floor. The stairway includes a bulkhead, an upper run of stairs, a lower run of stairs, and a landing. The top of the upper run of stairs is pivotally connected to the bulkhead, the bottom of the upper run of stairs is pivotally connected to the landing and the top of the lower run of stairs is pivotally connected to the landing side-by-side with the upper run of stairs. The pivotal connections permit the stairway to collapse in a compact configuration for transport and storage. The stairway may be lifted and then lowered into place for installation. When lifted, the stairway assumes an expanded position with the runs of stairs extending angularly from the landing and bulkhead, and hangers suspend the landing below the bulkhead.

11 Claims, 8 Drawing Figures

20
76
116
78
116
104
116
28
104
44
26
50
30
46
48
118
62
118
106
70U
66B
106
60
70L
64
58
58
54
70U
68
72
40U
32L
40L
52
62
70L
56
64
70U
66A
40U
60
34
38
36
72
70L
110
106
40L
64
108
118
32R
24
106
118

PREASSEMBLED PLATFORM STAIRWAY

The present invention relates to stairs and more particularly to a preassembled platform stairway providing important advantages in highrise building construction.

In a typical highrise building construction sequence, the floors of the structure are built in ascending order with aligned rough openings for a staircase. After adjacent floors are completed, service stairs are installed in the staircase. In accordance with one conventional practice, the stairway itself is assembled on site. For the widely used U type service stairs, the stairway may be made of prefabricated runs and landing platforms. These stairway components are delivered to the site as discrete units and are assembled and fitted in the staircase. This requires a high level of skill and care and is time consuming. In addition, since stairs of this type are not installed until after the adjacent floors are built, temporary stairs are required at the level of the building where new floors are being made.

In order to overcome the difficulties arising from on site stairway assembly and installation, preassembled stair units have also been used. A preassembled unit of the type used in the past includes a prefabricated rigid assembly of upper and lower stair runs and a landing platform as well as suitable supporting structure, handrails and the like if desired. This approach avoids the necessity for skilled workers on site to assemble the stairway, but has other disadvantages. One disadvantage is that a rigid, preassembled stairway cannot be readily adjusted to fit properly in a staircase. Another disadvantage is that this type of stairway assembly is bulky and is difficult to ship and to store pending installation on construction sites where limited storage space is often at a premium.

Among the important objects of the present invention are to provide an improved preassembled platform stairway; to provide a stairway assembly that is preassembled yet easily adjusted for proper fit in a staircase; to provide an assembly that can be lowered in place into a staircase opening at the level where floor construction is taking place; to provide a stairway assembly avoiding the necessity for transporting discrete components and assembling them in place; to provide a preassembled stairway capable of being compactly stored for transport and for on site storage; and to provide a stairway overcoming disadvantages of those used in the past.

In brief, in accordance with the above and other objects of the present invention, there is provided a preassembled platform stairway for installation in a staircase between floors at adjacent levels in a building structure. The stairway includes upper and lower stair runs and a landing adapted to be installed in the staircase at an intermediate level between adjacent floors. The upper and lower runs of stairs are pivotally mounted to the landing and can pivot to a first position for transport and storage where the runs are generally aligned with the landing and a minimum of space is required. The runs can pivot to second positions angularly extending from the landing to the upper and lower adjacent floor levels.

In accordance with the invention, the stairway may also include a bulkhead formed as a rectangular frame corresponding to the staircase opening in the upper of the adjacent floors. Hangers suspend the landing below and generally parallel to the bulkhead. The entire assembly can be lifted by lifting the bulkhead and can then be lowered into place in the staircase with the bulkhead providing part of the form or structure for completion of the upper of the two adjacent floors connected by the staircase.

The present invention together with the above and other objects and advantages may best appear from the following detailed description of the embodiment of the invention illustrated in the drawings wherein:

FIG. 8 is an exploded perspective view of some of the components of the stairway.

Figures 1, 2:
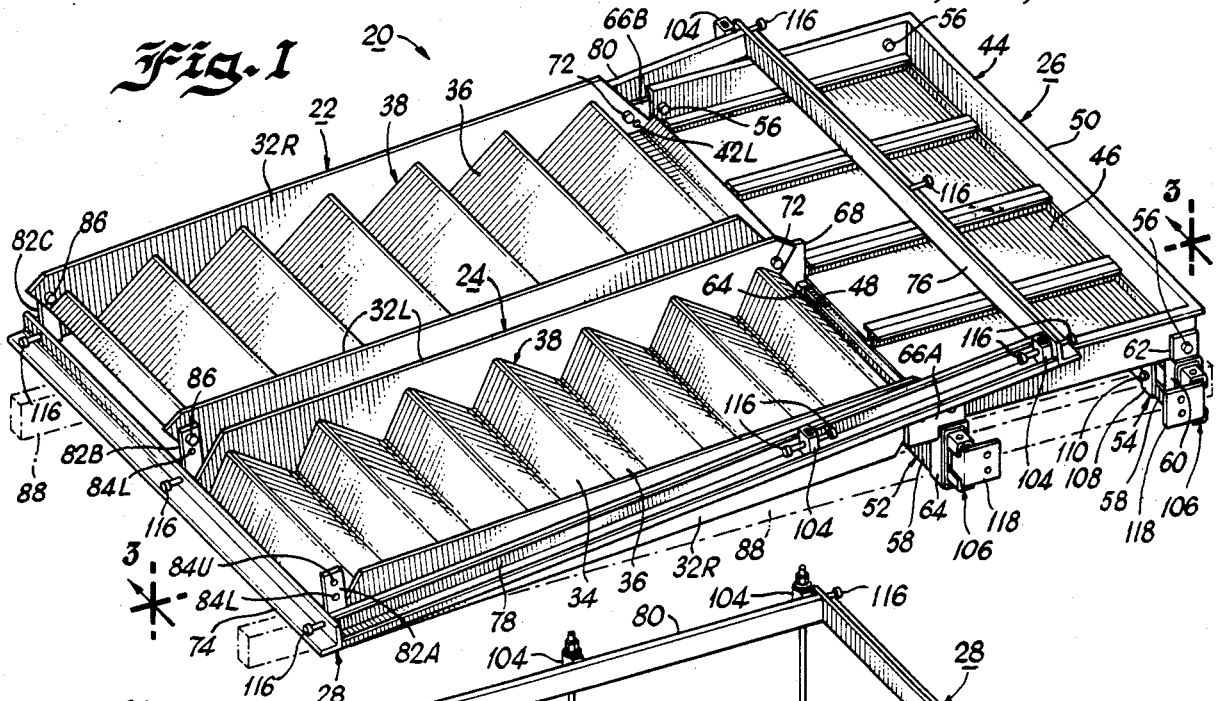
FIG. 1 is a perspective view of a preassembled platform stairway constructed in accordance with the present invention, illustrated in its collapsed position for transport and/or storage prior to installation.
FIG. 2 is a perspective view illustrating the stairway of FIG. 1 in its extended condition prior to installation in a building.

Having reference now to the drawings and initially to FIGS. 1 and 2, there is illustrated a preassembled platform stairway generally designated by the reference numeral 20 and constructed in accordance with the principles of the present invention. Stairway 20 provides important advantages when installed in a highrise structure to provide U type service stairs, although principles of the invention may be applied to stairs of other types.

In general, stairway 20 includes an upper run of stairs generally designated as 22, a lower run of stairs generally designated as 24 and a landing or platform generally designated as 26. In accordance with an important feature of the invention, the runs 22 and 24 are preassembled to the landing 26 for pivotal movement between a compact first position illustrated in FIGS. 1 and 3 and an extended second position illustrated in FIGS. 2, 4 and 5. In the first position, the stairway 20 is quite compact and numerous ones of similar stairways may be stacked one upon the other for transport and on site storage. In the expanded position, stairway 20 is installed to provide stairs between adjacent floors of a building.

In the illustrated embodiment of the invention, stairway 20 also includes a bulkhead generally designated as 28 pivotally connected to upper run 22. Hangers in the form of hanger rods 30 suspend the landing 26 below the bulkhead 28 in the extended condition of the stairway 20 so that the stairway can be lifted by lifting the bulkhead 28 and can be lowered into its installed position.

Upper and lower runs 22 and 24 are fabricated as identical components providing economies in the manufacture of stairway 20. However, the principles of the present invention also provide advantages in other arrangements, for example where the total rise of one of the runs differs from the rise of the other. Both runs 22 and 24 include spaced apart stringers 32R and 32L at the right and left of an ascending user. Risers and treads, for example 34 and 36, are provided by a one-piece unit 38 fabricated of steel safety plate or safety tread material.

Numerous variations are possible in details of the stair design. For example, poured concrete treads may be provided by using tray components to form the stair treads. An open staircase may be provided by omitting the risers. The stringers may be of the open rather than the illustrated closed type. The number of steps, total rise and the total run of the upper and lower runs 22 and 24 need not be equal. Thus, a stairway in accordance with the present invention may be designed to fit and complement the design of many different buildings.

Figure 3:
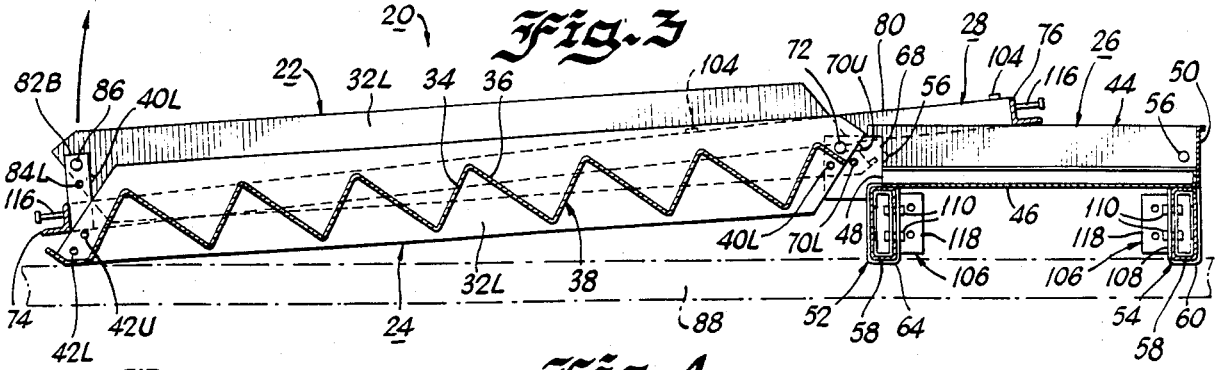
FIG. 3 is a sectional view taken along the line 3—3 of FIG. 1.

The upper end of each stringer 32R and 32L is provided with a vertically spaced apart pair of openings 40U (upper) and 40L (lower) as best seen in FIG. 8. Similarly, as best seen in FIG. 3, the lower end of each stringer 32R and 32L is provided with a vertically spaced apart pair of openings 42U (upper) and 42L (lower).

Landing or platform 26 is of a tray configuration including an upstanding wall 44 at three sides and a bottom wall 46. The tray configuration serves as a form so that a concrete landing floor may be poured after the stairway 20 is installed. Other configurations are possible. For example, the landing 26 may include a floor member formed of safety plate or other desired material.

In the illustrated arrangement, typical of service stairs in many highrise constructions, the landing 26 is generally rectangular and includes a forward edge 48 and a rear edge 50 extending in the long direction of the rectangular shape. A pair of support tube assemblies 52 and 54 are attached by bolts 56 respectively along the forward and rear edges 48 and 50. Tube assemblies 52 and 54 strengthen the landing 26 and facilitate mounting of the stairway 20 in different types of installations as described below.

Both tube assemblies 52 and 54 include an elongated, generally C-shaped tube member 58. The rear tube assembly 54 includes a collar 60 at each of its ends carrying upstanding mounting flanges 62 for receiving mounting bolts 56. The forward tube assembly 52 includes three collars 64, one at each end and one roughly midway along the tube member 58. The end collars are provided with upstanding flanges 66A and 66B for receiving mounting bolts 56, while the central collar 64 is provided with an upstanding flange 68 lying entirely forward of the landing bottom wall 46. Flanges 66A, 66B and 68 are all provided with an upper slot-shaped opening 70U and a lower opening 70L. These openings are located forward of the front edge 48 of landing 26.

When the stairway 20 is preassembled, openings 42L of the upper run 22 are aligned with openings 70U of flanges 66B and 68. Similarly, openings 40U of lower run 24 are aligned with openings 70U of flanges 68 and 66A. Bolts 72 are placed in these openings to preassemble the runs 22 and 24 to the landing 26. Bolts 72 are aligned on a common axis and act as pivot pins permitting pivotal movement of runs 22 and 24 relative to landing 26 between the collapsed or first and extended or second positions.

Bulkhead 28 is a generally rectangular frame formed of end members 74 and 76 and side members 78 and 80. End members 74 and 76 are generally L-shaped in cross section while the longer side members 78 and 80 have a cross section that is L-shaped with additional flange portions for increased strength. These members are attached together as by welding to form a strong and rigid construction. End member 74 forms the front portion of the bulkhead 28 and is provided with three similar flanges 82A, 82B and 82C each including an upper opening 84U and a vertically offset lower opening 84L. Flanges 82A and 82C are disposed at opposite sides of the bulkhead with flange 82B located approximately midway across the width of the bulkhead.

When the stairway 20 is preassembled, the openings 40U of stringers 32R and 32L of the upper run 22 are aligned with the openins 84U in the flanges 82B and 82C. Bolts 86 are attached through these aligned openings to interconnect the bulkhead 28 and the upper run 22. Bolts 86 are aligned and serve as pivot pins permitting pivotal movement of the upper run 22 with respect to the bulkhead 28 between the first, collapsed position of FIGS. 1 and 3 and the second, expanded position of FIGS. 2, 4 and 5.

In the collapsed position illustrated in FIGS. 1 and 3, the stairway 20 requires a minimum of space since the landing 26, the upper and lower runs 22 and 24, and the bulkhead 28 are located generally coplanar in a generally flat configuration. Yet these parts are all interconnected by bolts 72 and 86 so that the stairway 20 may be transported, stored and handled as a compact unit. This unit may be transported and stored on site, for example on suitable skids 88 shown in broken lines in FIGS. 1 and 3, and numerous ones of similar stairways 20 may be stacked one upon another using suitable blocks or chocks.

Figure 4:
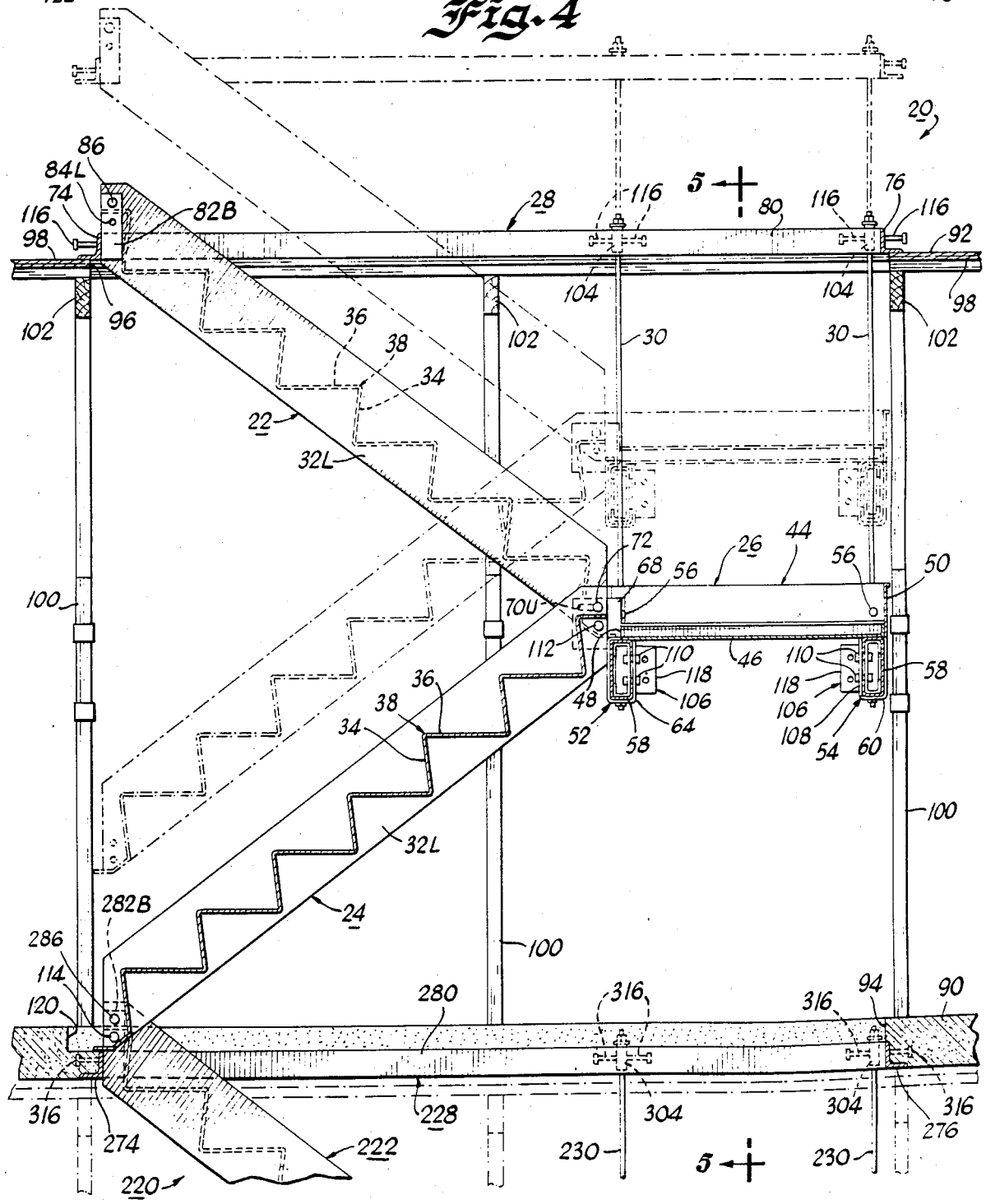
FIG. 4 is a sectional view taken along the line 4—4 of FIG. 3 and illustrating the stairway being installed between adjacent floors of a building.
Figure 5:
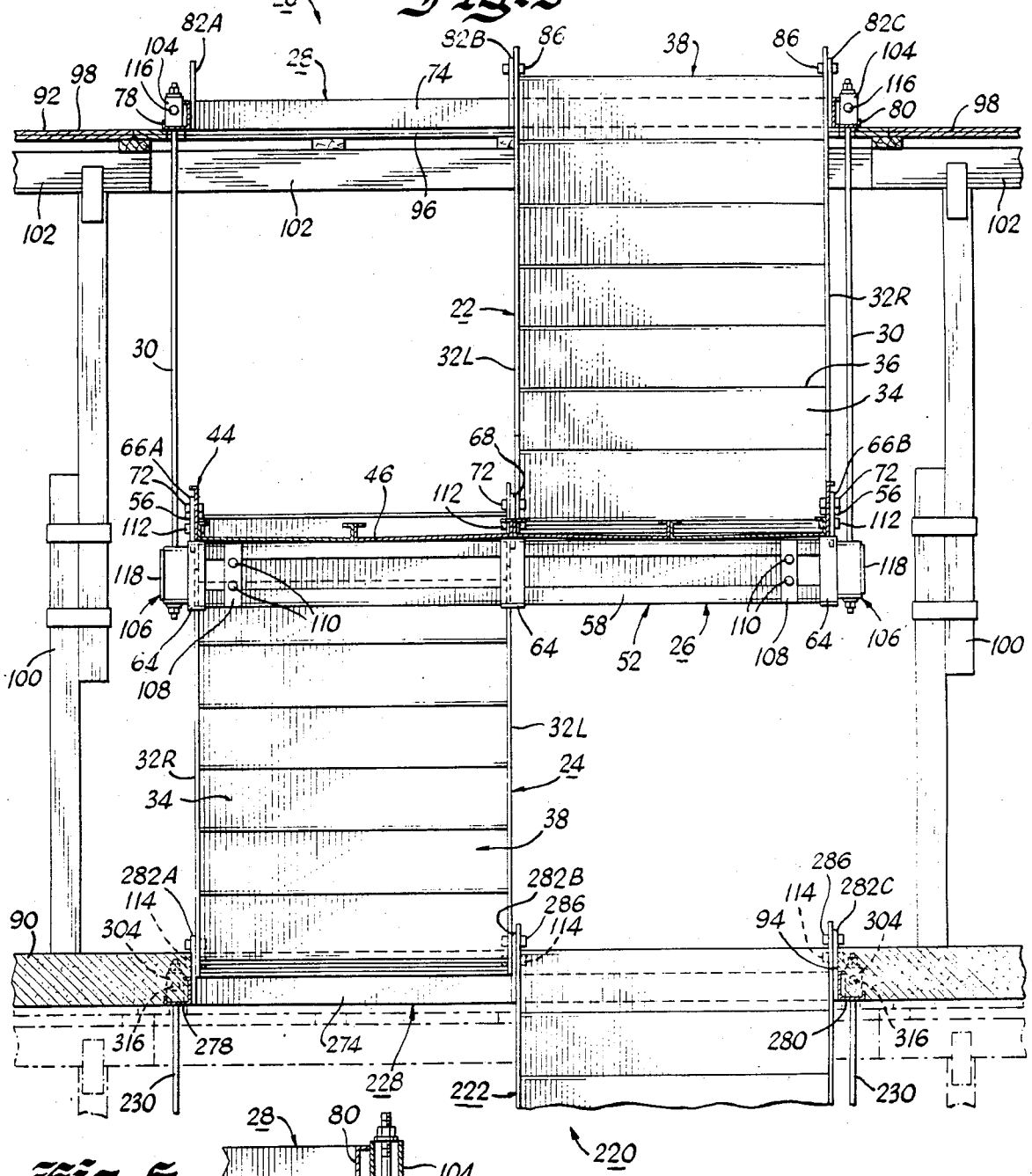
FIG. 5 is a sectional view taken along the line 5—5 of FIG. 4.
Figure 6:
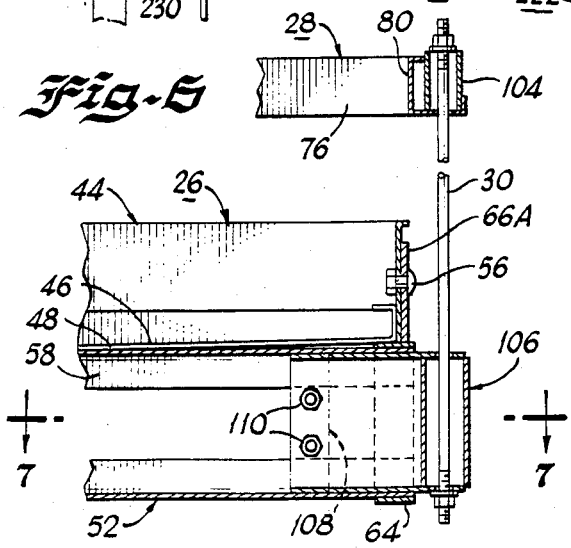
FIG. 6 is an enlarged fragmentary sectional view taken along the line 6—6 of FIG. 2.
Figure 7:
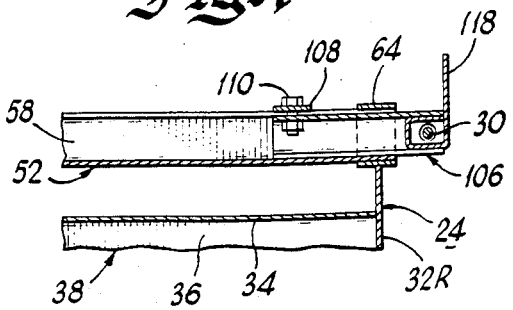
FIG. 7 is a sectional view taken along the line 7—7 of FIG. 6.
Figure 9:
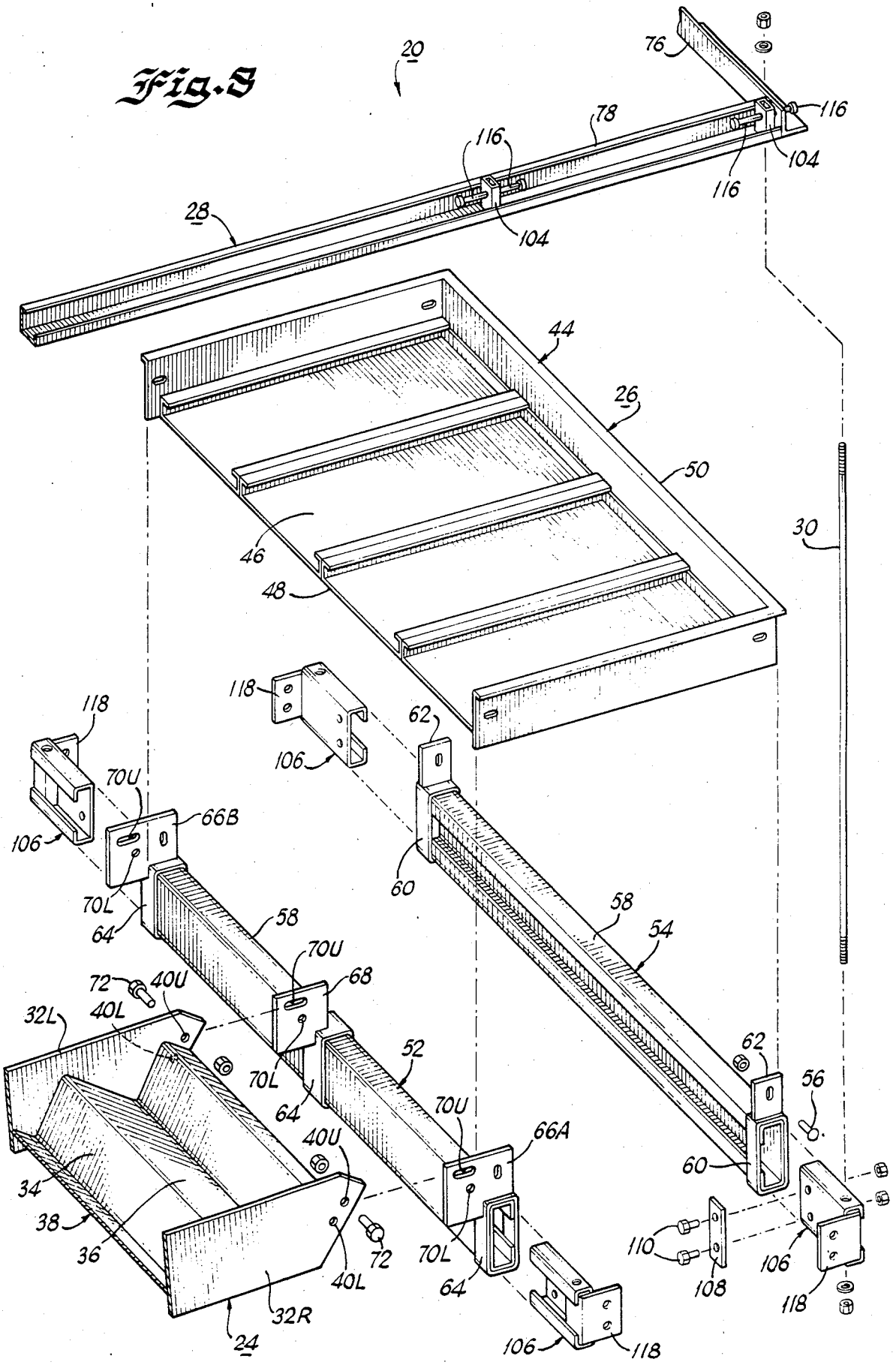

Installation of stairway 20 to form service stairs in one typical type of building construction is shown in FIGS. 4 and 5. In this building construction, numerous floor levels are provided and these figures illustrate a completed lower floor 90 and an adjacent upper floor 92 in the process of being constructed. The staircase or region to receive the stairway 20 is defined by stair openings 94 and 96 in the lower and upper floors 90 and 92 respectively. As illustrated in FIGS. 4 and 5, a stairway 220 similar to stairway 20 has previously been installed between lower floor 90 and the floor below floor 90 (not shown). Components of this previously installed stairway 220 are designated by similar reference characters increased by 200.

One advantage of stairway 20 is that it is installed as upper floor 92 is being constructed, rather than after construction is completed. The illustrated building is of the type including poured concrete slab floors between which stud walls are later be built. Thus, lower floor 90 is illustrated as a completed poured concrete slab, while upper floor 92 is defined prior to pouring of concrete by forms 98 supported by temporary posts 100 and beams 102.

Prior to completion of the upper floor 92, stairway 20 is placed in the position illustrated in FIGS. 4 and 5. This is accomplished in accordance with the invention by lifting bulkhead 28, for example with a crane, from a transport vehicle or from an onsite storage location. Lifting of the bulkhead 28 causes the initially collapsed stairway to assume the expanded position shown in FIGS. 2, 4 and 5.

Hanger rods 30 are installed to hold the landing 26 suspended beneath the bulkhead 28 as the stairway 20 is lifted. The width of bulkhead 28 is generally equal to the length of landing 26. Four hanger rods 30 are used, one at each corner of the landing 26. The upper ends of the hanger rods 30 are received in sockets 104 attached to the bulkhead 28, and the lower ends are received in openings provided in slide members 106 carried at opposite ends of each of the tube assemblies 52 and 54 associated with the landing 26.

Opposed ends of the hanger rods 30 are threaded, and nuts are used for attachment so that the landing 26 is vertically adjustable with respect to the bulkhead 28. Lateral adjustability is provided by the slide members 106, each of which is horizontally movable in its corresponding tube member 58. A locking plate 108 is attached by fasteners 110 to lock the slide members 106 in position in the tube members 58 (FIG. 8). Lifting of stairway 20 with hangers 30 in position pulls the upper run 22 and the landing 26 to the expanded position. The lower run 24 pivots downwardly, and is held generally in the position shown in FIG. 2 due to engagement of its stringers 32R and 32L with the forward tube assembly 52 of the landing 26.

After being lifted, the stairway 20 may be lowered, for example by a crane, through the upper stair opening 96 toward its installed position as shown in broken lines in FIG. 4. When the installed position is reached, the bulkhead 28 rests upon the edge of the upper stair opening 96, the landing 26 is disposed horizontally between the lower and upper adjacent floors 90 and 92, and the lower end of the lower stair run 24 is received between flanges 282B and 282C of the previously installed stairway 220. Although the stairway 20 is transported, stored and handled as a preassembled unit, at the time of installation adjustment is possible to accommodate the staircase dimensions since the stair runs 22 and 24, the landing 26 and the bulkhead 28 are pivotally interrelated and since the hanger rods 30 are adjustable both vertically and horizontally. Thus the stairway 20 can readily be accommodated to the wide dimensional tolerances found in building construction.

When the staircase has been lowered into position and adjusted for proper fit, its components are rigidly attached together in the finished installation. In the expanded position, openings 42L of the upper run 22 and 40L of the lower run 24 are aligned with openings 70L of landing 26, and bolts 112 are installed in these openings. Openings 42L of the lower run 24 are aligned with openings 284L of the previously installed stairway 20, and bolts 114 are installed in these aligned openings. When all of the bolts are tightened, and with locking plates 108 also fastened in place, the entire stairway 20 is rigidly installed in its finally adjusted and permanent position.

As seen in FIG. 5, bulkhead 228 defines at least part of the stairway opening in the finished building floor. When upper floor 92 is completed, bulkhead 28 forms at least part of the stair opening 96. The sides and ends 74–80 of the bulkhead 28 may, if desired, be made of greater vertical height to provide the forms for the entire floor thickness, or, as illustrated, additional forms may be required for part of the floor thickness. Anchors 116 are provided at spaced locations around the circumference of the bulkhead 28 firmly to embed the bulkhead in the poured concrete floor.

After installation of the stairway 20 and completion of the upper floor 92, stud walls may be built to enclose the staircase. When this is done, the hanger rods 30 and the projecting portions of the slide members 106 may be enclosed behind these walls.

The stairway 20 may be installed in different types of buildings having differing floor and wall constructions. For example, the stairway may be installed in a building with concrete floors and shear walls defining the staircase opening already in place. In this type of installation, flanges 118 on the slide members 106 may be attached directly to the staircase walls. The hanger rods 32 may be removed when the staircase is installed, or other types of hanger elements may be used for lifting and lowering the staircase. In some installations, the bulkhead 28 may be omitted, or may be removed after the stairway is lowered in place in the building. In the particular installation illustrated in the drawings, a void 120 (see lower left of FIG. 4) is left when a floor is poured for attachment of the lower end of the lower run 24. This void may be filled after final installation of the stairway 20.

While the invention has ben described in connection with details of the preferred embodiment illustrated in the drawings, such details are not intended to limit the scope of the invention as defined in the following claims.

I claim:

1. A preassembled platform stairway for installation in a staircase between floors of adjacent levels, said stairway comprising in combination:

upper and lower stair runs each including stringers and treads and each having upper and lower ends;

a landing adapted to be installed in said staircase at an intermediate level between said adjacent levels; and the improvement in accordance with which the upper end of said lower run and the lower end of said upper run are each pivotally connected to said landing for pivotal movement between first positions generally aligned with said landing and second positions in which said runs extend angularly from said landing upwardly and downwardly respectively to said adjacent levels.

2. A preassembled platform stairway as claimed in claim 1 further comprising attachment points on said landing and said upper and lower runs aligned in said second positions of said runs for nonpivotally connecting said runs to said landing in said second positions.

3. A preassembled platform stairway as claimed in claim 1, further comprising laterally adjustable support members mounted on said landing.

4. A preassembled platform stairway as claimed in claim 1, said landing having a forward edge, said runs being pivotally connected side-by-side to said forward edge.

5. A preassembled platform stairway as claimed in claim 4, the upper end of said upper run and the lower end of said lower run including cooperating attachment points for connection respectively to corresponding runs of similar stairways extending beyond the floors of said adjacent levels.

6. A preassembled platform stairway as claimed in claim 1 further comprising a bulkhead pivotally connected to the upper end of said upper run.

7. A preassembled platform stairway as claimed in claim 6 further comprising hanger means extending between said bulkhead and said landing for suspending said landing generally parallel to and below said bulkhead.

8. A preassembled platform stairway as claimed in claim 7, said hanger means comprising a plurality of adjustable, vertically extending rods.

9. A stairway assembly adapted to be lowered through a staircase opening in an upper floor to provide stairs from an adjacent lower floor, said assembly comprising:

a bulkhead defined by a generally rectangular frame;

an upper run of stairs having an upper end joined by a first pivotal connection to said bulkhead permitting said upper run to pivot between positions respectively generally coplanar with and angularly related to said bulkhead;

a generally rectangular landing defined by a platform having a width generally equal to the width of said bulkhead and a depth substantially less than the length of said bulkhead;

a second pivotal connection joining the lower end of said upper run to said landing for pivotal movement of said upper run between positions generally coplanar with and angularly related to said landing; and a lower run of stairs having an upper end joined by a third pivotal connection to said landing permitting said lower run to pivot between positions respectively generally coplanar with and angularly related to said landing.

10. The stairway assembly of claim 9 further comprising hangers extending at spaced locations between said bulkhead and said landing for suspending said landing beneath said bulkhead.

11. The stairway assembly of claim 9 wherein said first, second and third pivotal connections include attachment means for fixing the pivotal connections in a nonpivotal condition.

* * * * *